US007307648B2

(12) United States Patent
Yokoyama et al.

(10) Patent No.: US 7,307,648 B2
(45) Date of Patent: Dec. 11, 2007

(54) PRINTING APPARATUS AND METHOD FOR PASSBOOKS

(75) Inventors: Masato Yokoyama, Yokohama (JP); Toshiaki Aoyagi, Koga (JP)

(73) Assignee: Kabushiki Kaisha Toshiba, Tokyo (JP)

( * ) Notice: Subject to any disclaimer, the term of this patent is extended or adjusted under 35 U.S.C. 154(b) by 239 days.

(21) Appl. No.: 11/135,665

(22) Filed: May 24, 2005

(65) Prior Publication Data

US 2005/0265737 A1 Dec. 1, 2005

(30) Foreign Application Priority Data

May 28, 2004 (JP) ..... 2004-159987

(51) Int. Cl.
*B41J 2/32* (2006.01)

(52) U.S. Cl. ..... 347/219; 347/213; 400/618

(58) Field of Classification Search ..... 347/171, 347/172, 213, 219; 400/120.01, 617, 618
See application file for complete search history.

(56) References Cited

U.S. PATENT DOCUMENTS 5,430,522 A 7/1995 Kobayashi et al.
2001/0010535 A1* 8/2001 Andoh et al. ..... 347/213
2003/0030833 A1 2/2003 Mochizuki et al.

FOREIGN PATENT DOCUMENTS

| | | |
|---|---|---|
| EP | 0 228 749 | 7/1987 |
| EP | 0 501 216 A1 | 9/1992 |
| JP | 2003-252498 A | 9/2003 |
| JP | 2004-074557 A | 3/2004 |

OTHER PUBLICATIONS

Machine-generated translation of JP 2003-252498.*
Machine-generated translation of JP 2004-074557.*
European Search Report dated Jun. 29, 2006 for Appln. No. 05010957.8-2304.

* cited by examiner

*Primary Examiner*—Huan Tran
(74) *Attorney, Agent, or Firm*—Pillsbury Winthrop Shaw Pittman, LLP

(57) ABSTRACT

A passbook printing apparatus comprises a movable tension roller correcting slack of an intermediate transfer film resulting from a different in a feed speed between a film drive roller and a film wind-up reel, and a control device operating the film wind-up reel to apply a predetermined tension to the intermediate transfer material in a state of stopping the film drive roller, thereby moving and fixing the tension roller to a predetermined position, and thereafter, feeding the intermediate transfer film by a predetermined distance by the film drive roller to position it to the transfer position.

12 Claims, 6 Drawing Sheets

Tension roller : free state

Tension roller : fixed state

PRINTING APPARATUS AND METHOD FOR PASSBOOKS

CROSS-REFERENCE TO RELATED APPLICATIONS

This application is based upon and claims the benefit of priority from prior Japanese Patent Application No. 2004-159987, filed May 28, 2004, the entire contents of which are incorporated herein by reference.

BACKGROUND OF THE INVENTION

1. Field of the Invention

The present invention relates to printing apparatus and method for passbooks (bankbooks) used for financial institutions.

2. Description of the Related Art

For example, there has been known a printing apparatus for passbook disclosed in JPN. PAT. APPLN. KOKAI Publication No. 2004-74557 as the foregoing apparatus. The printing apparatus prints characters on an intermediate transfer film using single-color printing ink by a thermal head, or overlaps several color printing inks to print images. Then, the printing apparatus transfers the printed characters and images to a specified position on medium such as passbook and card.

There is the case where feed speed and feed distance of the intermediate transfer film required for print and transfer are different. In this case, if print and transfer are simultaneously made independently from each other, slack occurs in the intermediate transfer film. A slack correction (absorption) mechanism 101 shown in FIG. 9 corrects (absorbs) the slack of the transfer film. The slack correction mechanism has rotatable arm 101*b*, tension roller 101*c*, receiver roller 101*d*, and spring material 101*e*. Specifically, the rotatable arm 101*b* is rotatable around the fulcrum roller 101*a*. The tension roller 101*c* is attached to one end of the rotatable arm 101*b*; on the other hand, the receiving roller 101*d* is attached to the other end thereof. The spring material 101*e* gives urging force to rotate the rotatable arm 101*b* to the counterclockwise direction.

The tension roller 101*c* is moved upwardly by the urging force of the spring material 101*e* to give tension to the intermediate transfer film F. By doing so, the slack occurring in the intermediate transfer film F is absorbed.

If image and character printed on the intermediate transfer film F are transferred to a specified position on the medium, the film F and the medium must be accurately positioned to the transfer position.

The intermediate transfer film F is positioned in the following manner. Specifically, a detector reads a mark recorded on the film F, and thereafter, the film F is fed by a predetermined distance, and thereby, the image and character are stopped to the transfer position. By doing so, the intermediate transfer film F and the medium are positioned so that the transfer of the image and character to the specified position on the medium is achieved.

However, when positioning the intermediate transfer film F, the feed path length of the film to the transfer position is variable depending on the place where the tension roller 101*c* is positioned. For this reason, the intermediate transfer film is not accurately positioned.

In order to position the intermediate transfer film, the tension roller 101*c* must be fixed after moved to a predetermined position to make constant the feed path length of the film to the transfer position.

Conventionally, the other end of the rotatable arm 101*b* is provided with cam mechanism 103 and drive mechanism for driving the cam mechanism 103. In order to position the intermediate transfer film, the cam mechanism 103 is rotated to abut against the receiver roller 101*d* of the rotatable arm 101*b*. By doing so, the tension roller 101*c* is moved and fixed to the predetermined position.

However, according to the prior art, the foregoing cam and drive mechanism 103 and 104 are specially required as a mechanism for fixing the tension roller 10*c*. For this reason, the following problems arise; more specifically, the configuration becomes complicated while the cost becomes high. Moreover, placement space is required; for this reason, the mechanism is made into a large size.

BRIEF SUMMARY OF THE INVENTION

The present invention has been made in view of the foregoing circumstances. An object of the present invention is to provide printing apparatus and method for passbooks, which can move and fix a tension roller to a predetermined position without using special mechanisms when positioning an intermediate transfer member to a transfer position.

According to one aspect of the present invention, there is provided a printing apparatus for passbooks comprising:

a first feed device feeding an intermediate transfer material at a first speed;

a print device printing information on the intermediate transfer material fed by the first feed device at a print position;

a second feed device feeding the intermediate transfer material printed with information by the print device to a transfer position at a second speed different from the first speed;

a transfer device transferring print information of the intermediate transfer material fed to the transfer position by the second feed device to passbooks;

a slack correction device stretching the intermediate transfer material across a tension roller, and correcting slack of the intermediate transfer material resulting from a difference in the feed speed between the first and second feed devices by movement of the tension roller; and a control device operating the second feed device to apply a predetermined tension to the intermediate transfer material in a state of stopping the first feed device, thereby moving and fixing the tension roller to a predetermined position, and thereafter, feeding the intermediate transfer material by a predetermined distance by the first feed device to position it to the transfer position.

According to one aspect of the present invention, there is provided A printing apparatus for passbooks comprising:

a first feed device feeding an intermediate transfer material at a first speed;

a print device printing information on the intermediate transfer material fed by the first feed device at a print position;

a second feed device feeding the intermediate transfer material printed with information by the print device to a transfer position at a second speed different from the first speed;

a transfer device transferring print information of the intermediate transfer material fed to the transfer position by the second feed device to passbooks;

a slack correction device stretching the intermediate transfer material across a tension roller, and correcting slack of the intermediate transfer material resulting from a difference in the feed speed between the first and second feed devices by movement of the tension roller; and a control device operating the second feed device to apply a predetermined tension to the intermediate transfer material in a state of stopping the first feed device, thereby moving and fixing the tension roller to a predetermined position, and thereafter, feeding the intermediate transfer material by a predetermined distance by the first feed device to position it to the transfer position, while again operating the first feed device to feed the intermediate transfer material by a predetermined distance in a state of stopping the second feed device, and thereby, positioning it to the print position.

According to one aspect of the present invention, there is provided a printing method for passbooks comprising:

feeding an intermediate transfer material by a first feed device feeding at a first speed;

printing information on the intermediate transfer material fed by the first feed device at a print position;

feeding the intermediate transfer material printed with information by the print device to a transfer position by a second feed device at second speed different from the first speed;

transferring print information of the intermediate transfer material fed to the transfer position by the second feed device to passbooks;

stretching the intermediate transfer material across a tension roller, and correcting slack of the intermediate transfer material resulting from a difference in the feed speed between the first and second feed devices by movement of the tension roller; and operating the second feed device to apply a predetermined tension to the intermediate transfer material in a state of stopping the first feed device, thereby moving and fixing the tension roller to a predetermined position, and thereafter, feeding the intermediate transfer material by a predetermined distance by the first feed device to position it to the transfer position.

According to one aspect of the present invention, there is provided a printing method for passbooks comprising:

feeding an intermediate transfer material by a first feed device feeding at a first speed;

printing information on the intermediate transfer material fed by the first feed device at a print position;

feeding the intermediate transfer material printed with information by the print device to a transfer position by a second feed device at second speed different from the first speed;

transferring print information of the intermediate transfer material fed to the transfer position by the second feed device to passbooks;

stretching the intermediate transfer material across a tension roller, and correcting slack of the intermediate transfer material resulting from a difference in the feed speed between the first and second feed devices by movement of the tension roller; and operating the second feed device to apply a predetermined tension to the intermediate transfer material in a state of stopping the first feed device, thereby moving and fixing the tension roller to a predetermined position, and thereafter, feeding the intermediate transfer material by a predetermined distance by the first feed device to position it to the transfer position, while again operating the first feed device to feed the intermediate transfer material by a predetermined distance in a state of stopping the second feed device, and thereby, positioning it to the print position.

According to one aspect of the present invention, the tension roller for correcting the slack of the intermediate transfer material is fixed without using specific fixing mechanism. Therefore, cost reduction is achieved, and an occupied space is reduced.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate embodiments of the invention, and together with the general description given above and the detailed description of the embodiments given below, serve to explain the principles of the invention.

DETAILED DESCRIPTION OF THE INVENTION

Embodiments of the present invention will be described below with reference to the accompanying drawings.

Figure 1:
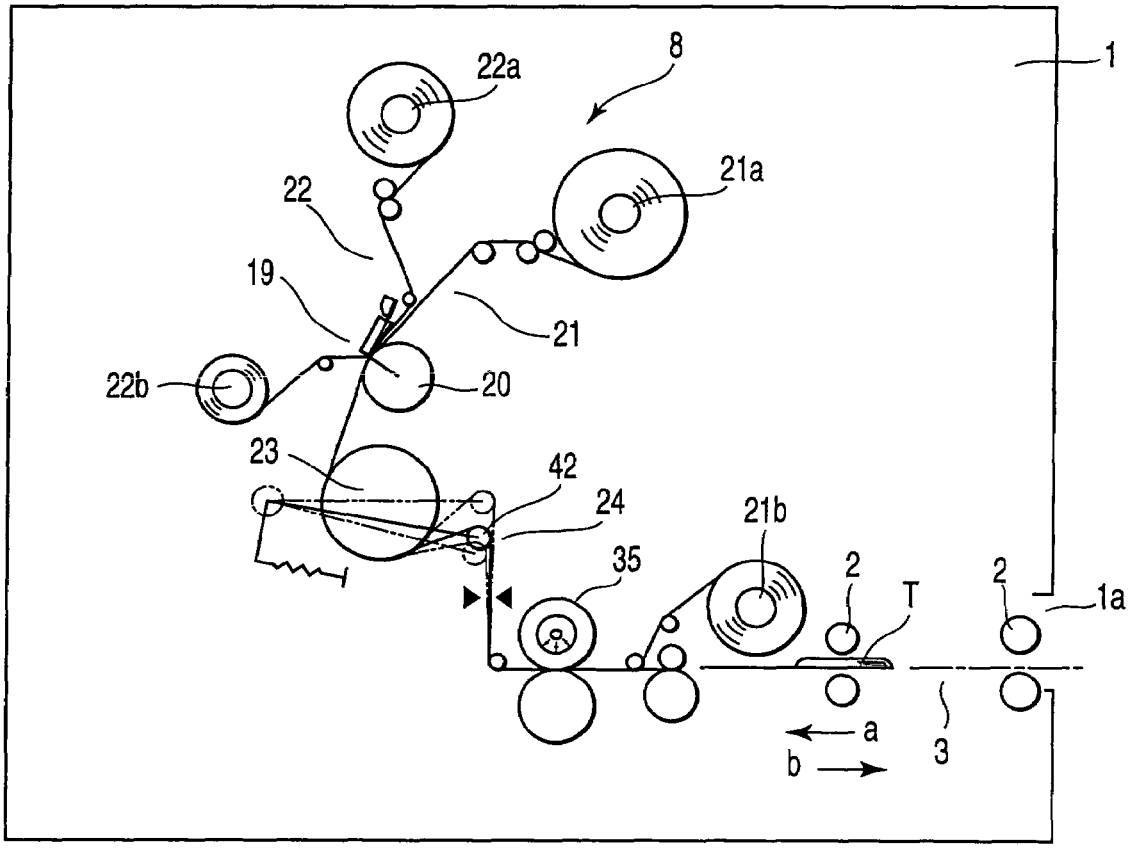
FIG. 1 is a schematic view showing the structure of a printing apparatus for passbooks according to one embodiment of the present invention.

FIG. 1 is a schematic view showing the configuration of a printing apparatus for passbooks according to one embodiment of the present invention.

The printing apparatus for passbooks includes a main body 1. The main body 1 is provided with an in-and-out slot 1*a* for passbooks T at the lower portion on the front side. The passbook T is inserted from the in-and-out slot 1*a* to the direction shown by the arrow "a" one by one in a state of being opened.

The inserted passbook T is fed along a feed path 3 according to the forward rotation of several feed roller pairs 2, which function as a feed device. The feed path 3 is provided with page mark detection sensor (not shown) and intermediate transfer print section 8 along the feed direction of the passbook T. The intermediate transfer printing section 8 functions as print device and transfer device. After being printed, the passbook T is fed to the direction shown is by the arrow "b" according to the backward rotation of the feed roller pair 2, and then, returned to the insert slot 1*a*.

Figure 8:
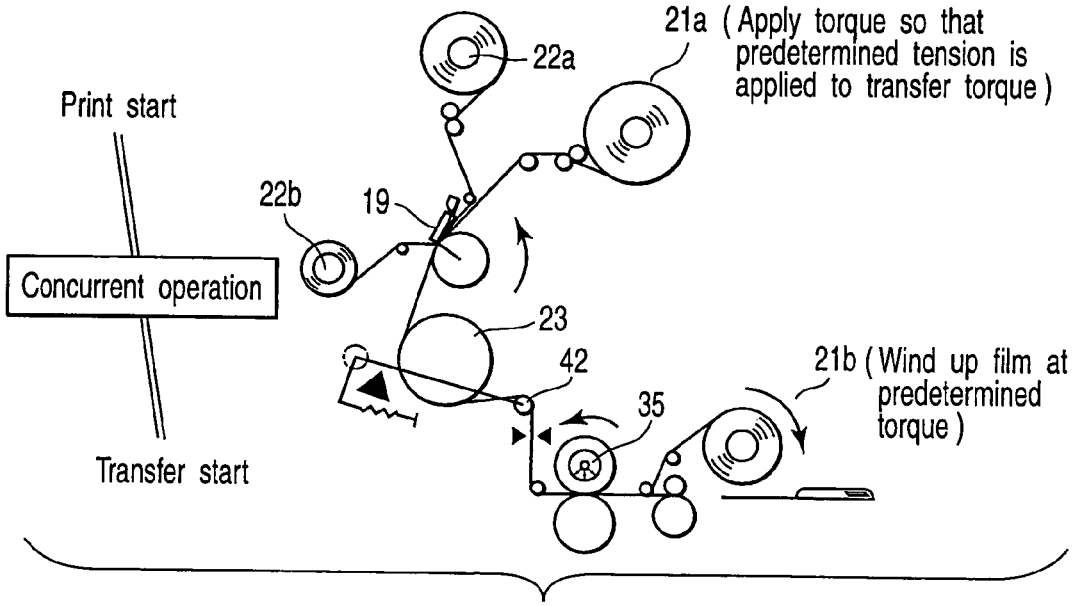
FIG. 8 is a view to explain the print and transfer operations of the second embodiment.
Figure 9:
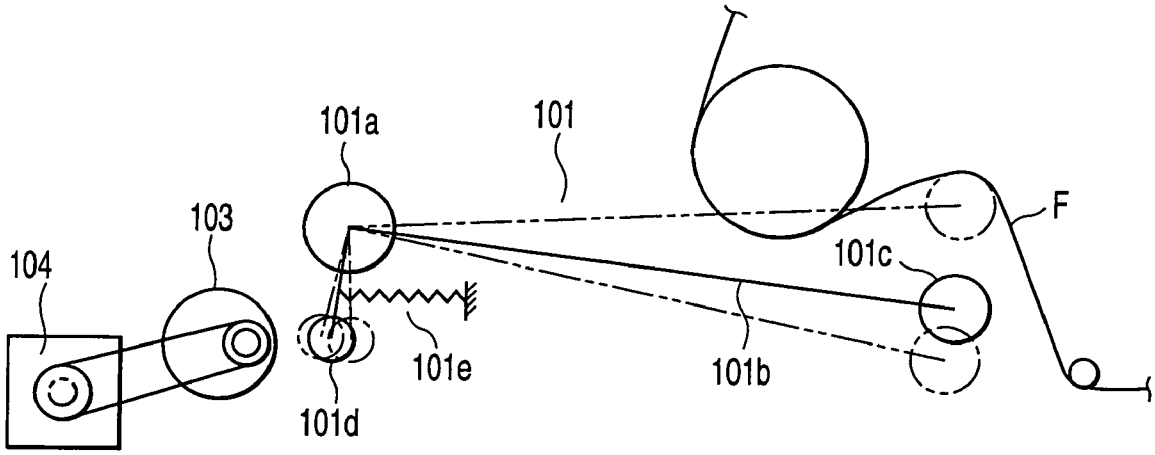
FIG. 9 (PRIOR ART)
FIG. 9 is a schematic view to explain a conventional mechanism for fixing a tension roller.
Figure 10:
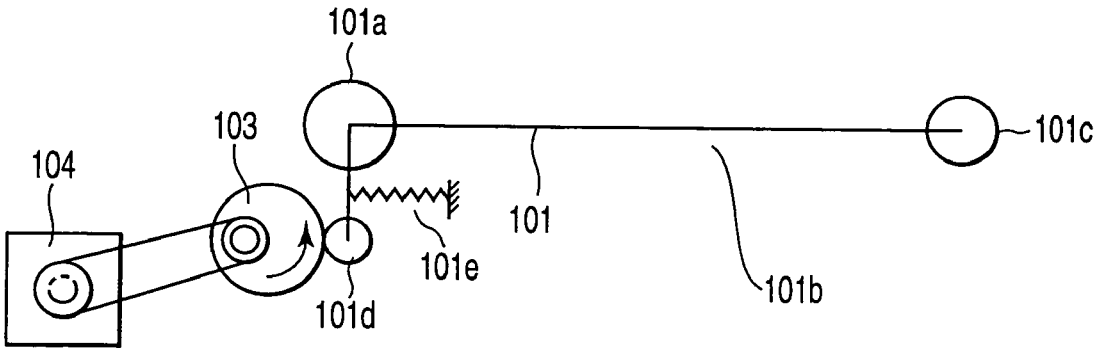
FIG. 10 (PRIOR ART)
FIG. 10 is a schematic view to explain a state that the tension roller is fixed using the mechanism.

FIG. 8 shows the structure of the foregoing intermediate transfer printing section 8.

The intermediate transfer printing section 8 functionally comprises information printing section (hereinafter, referred to as printing section) 16 and overcoat transfer section (hereinafter, referred to as transfer section) 17.

Thermal transfer printing is employed in the printing section 16. More specifically, thermal ink ribbon 22 and intermediate transfer material, that is, intermediate transfer film 21 are held between thermal head 19 and platen roller 20. Ink of the thermal ink ribbon 22 is transferred to the surface of the intermediate transfer film 21 by the thermal head 19 to print information.

The thermal ink ribbon 22 is supplied from a supply reel 22*a*, and wound up by a wind-up reel 22*b*. On the other hand, the intermediate transfer film 21 is supplied from a supply reel 21*a*, and wound up by a wind-up reel 21*b* functioning as a second feed device at a second speed.

According to the foregoing thermal transfer printing, image durability is high, and it is relatively easy to used functional materials (e.g., fluorescent pigment, aluminum deposition thin film) as the ink material. Therefore, the thermal transfer printing is adaptable to printed articles for the purpose of preventing forgery.

Base film thickness and ink layer thickness of the thermal ink ribbon 22 are extremely important parameters for print dot reproducibility. Thus, the ink ribbon layer thickness is 3 to 25 μm, preferably 4 to 10 μm.

On the other hand, base film thickness described later and image-received and adhesive layer thickness are parameters giving an influence to adhesion and film cutting characteristic. Thus, the layer thickness of the intermediate transfer film 21 is 10 to 100 μm, preferably 25 to 50 μm.

The platen roller 20 is a roller having a surface using a hardness rubber material. The more the rubber hardness increases, the more the microdot reproducibility is improved. However, it is difficult to obtain the optimum positional relationship between the platen roller 20 and the thermal head 19. Thus, the hardness is 75° or more, preferably, 85 to 97°. Likewise, the following condition is required in the surface roughness of the polished rubber surface. Namely, the more the surface smoothness increases, the more microdot reproducibility is improved. Thus, the surface roughness, that is, the centerline average roughness Ra is 1μ or less, preferably, about 0.5 μm or less.

The driving force to feed the intermediate transfer film 21 is given in the following manner. In general, the platen roller 20 is provided with a drive mechanism. However, frictional coefficient between the film 21 and the platen roller 20 does not increase resulting from the foregoing hardness and smoothness, and in addition is not stable. For this reason, a film drive roller 23 as a first feed device is specially provided at the downstream side (heat roller side) of the platen roller 20. The film drive roller 23 feeds the intermediate transfer film 21 at a first speed (faster than that of the second feed device). A roller having a hardness of 30° to 60° is used as the film drive roller 23. Preferably, the intermediate transfer film 21 is wound around the film drive roller 23 at a large angle as much as possible. In this embodiment, a tensioner 24 as a slack correction device is movably arranged to obtain a wind-up angle ranging from 90° to 130°.

The tensioner 24 is provided with a spring mechanism described later. The tensioner 24 gives tension to the intermediate transfer film 21 in a limited movable range to produce a state that the film drive roller 23 and the film 21 always properly contact with each other. The film drive roller 23 is driven by the combination of five-phase stepping motor, timing belt and reduction mechanism such as pulley, and thereby, accurately fed. Preferably, near edge or corner edge type is sued as the thermal head 19 to achieve printing.

The transfer section 17 includes heat roller 35 and backup roller 36, which are oppositely arranged via the passbook feed path 3. The heat roller 35 is accurately drivable at a constant speed by DC servomotor or stepping motor. The backup roller 36 is rotatably located, and pressed in contact with the heat roller 35 by urging force of a coil spring (not shown).

The foregoing film drive roller 23 and wind-up reel 21*b* are connected with a control device 18 via a control circuit. The drive is controlled in an operation of positioning the intermediate transfer film 21.

The printing operation of the passbook printing apparatus having the foregoing structure will be described below.

The thermal head 19 is operated based on print data, and then, information is printed on the surface of the intermediate transfer film 21 fed by the rotation of the film drive roller 23 at the first speed. The intermediate transfer film 21 printed with information is wound up to the forward direction (i.e., direction of heat roller 35) by the rotation of the wind-up reel 21*b*. In this manner, the printed information is sent to a transfer position.

In this case, the passbook T is inserted in a state that a page to be transferred is open, and then, fed to a predetermined transfer position with respect to the heat roller 35.

The transfer film 21 sent to the transfer position and the corresponding page of the passbook T are fed in a mutually overlapped state together with the rotation of the heat roller, and thereafter, pressed and heated. A transfer film base of the film 21 is pulled up at an angle of 60° to 110° with respect to the passbook T, and then, is completed, and thus, a passbook T to which print information is transferred is completed.

Figure 2:
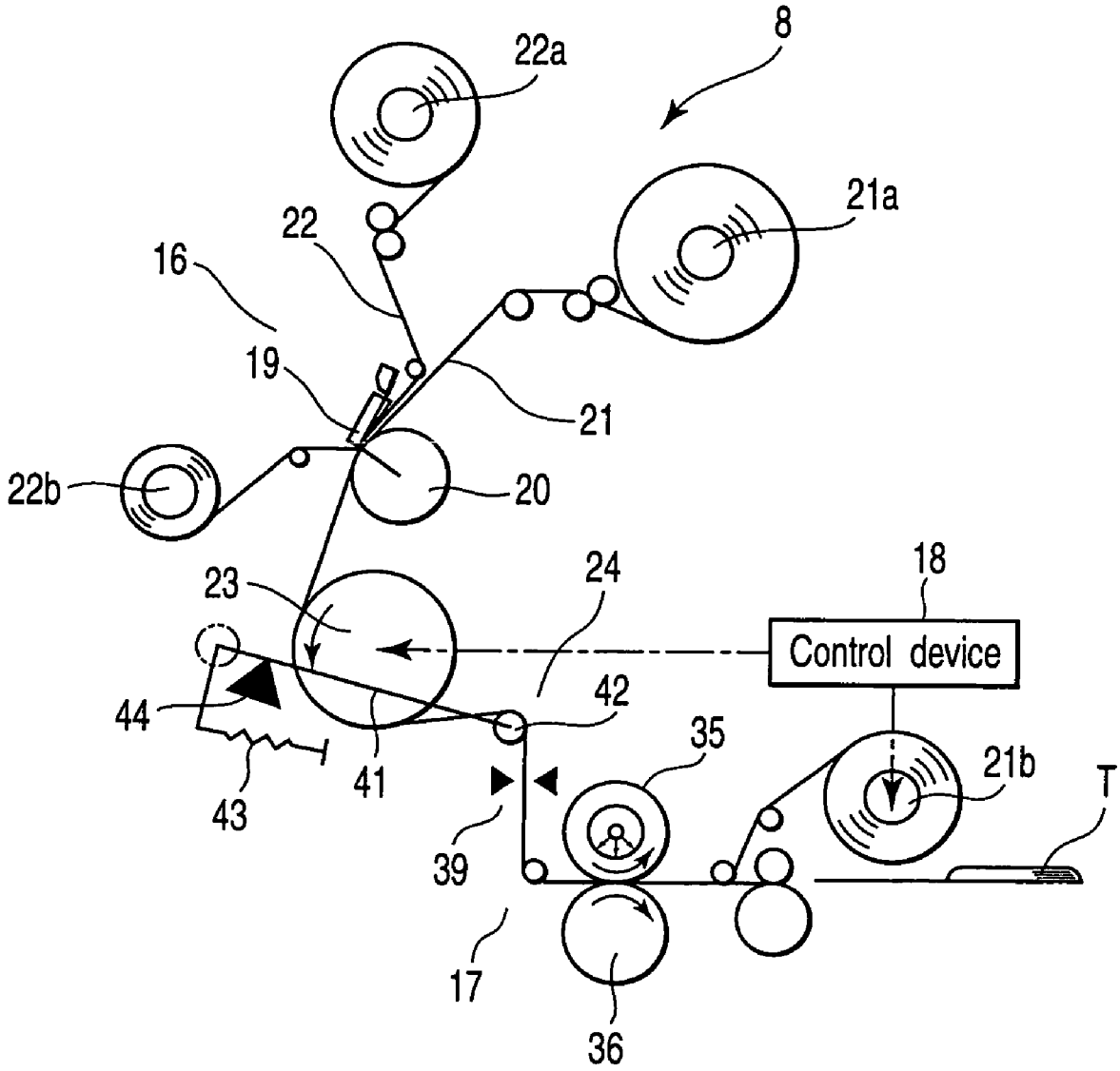
FIG. 2 is a schematic view showing the structure of a transfer print section included in the printing apparatus for passbooks.

The foregoing tensioner 24 is composed of L-shaped rotatable arm 41, tension roller 42, spring 43 and stopper 44 as seen from FIG. 2. Specifically, the tension roller 42 is attached to one end of the rotatable arm 41 to stretch the intermediate film 21 across there. The spring 43 functions as an urging member connected to the other end of the rotatable arm 41. The stopper 44 controls the rotation of the rotatable arm 41.

When the foregoing character and image are printed and transferred, slack occurs in the intermediate transfer film 21. The slack occurs resulting from the difference between film feed speed (first feed speed) and feed distance required for print and film feed speed (second feed speed) and feed distance required for transfer.

The slack of the intermediate transfer film 21 is corrected because the tension roller 42 upwardly moved by the urging force of the spring 43 pushes up the film 21.

When the foregoing character and image are printed and transferred, the passbook T is stopped at the transfer position. Simultaneously, a transfer mark detection sensor 39 senses a mark of the intermediate transfer film 21, and thereafter, the film 21 is fed by a predetermined distance. By doing so, the printed information is positioned on the transfer position.

However, in positioning the intermediate transfer film 21, the feed path length of the film 21 to the transfer position is variable depending on the place where the tension roller 42 is located. For this reason, even if the film 21 is fed by the predetermined distance after the transfer mark detection sensor 39 senses the mark of the film 21 as described above, accurate positioning is not achieved.

For this reason, the tension roller 42 is moved to a constant position, and then, fixed. By doing so, the feed path length of the film 21 to the transfer position is made constant, and thereafter, the film 21 must be positioned.

The operation of moving and fixing the tension roller to the constant position will be explained below with reference to FIG. 3 and FIG. 4.

Figure 3:
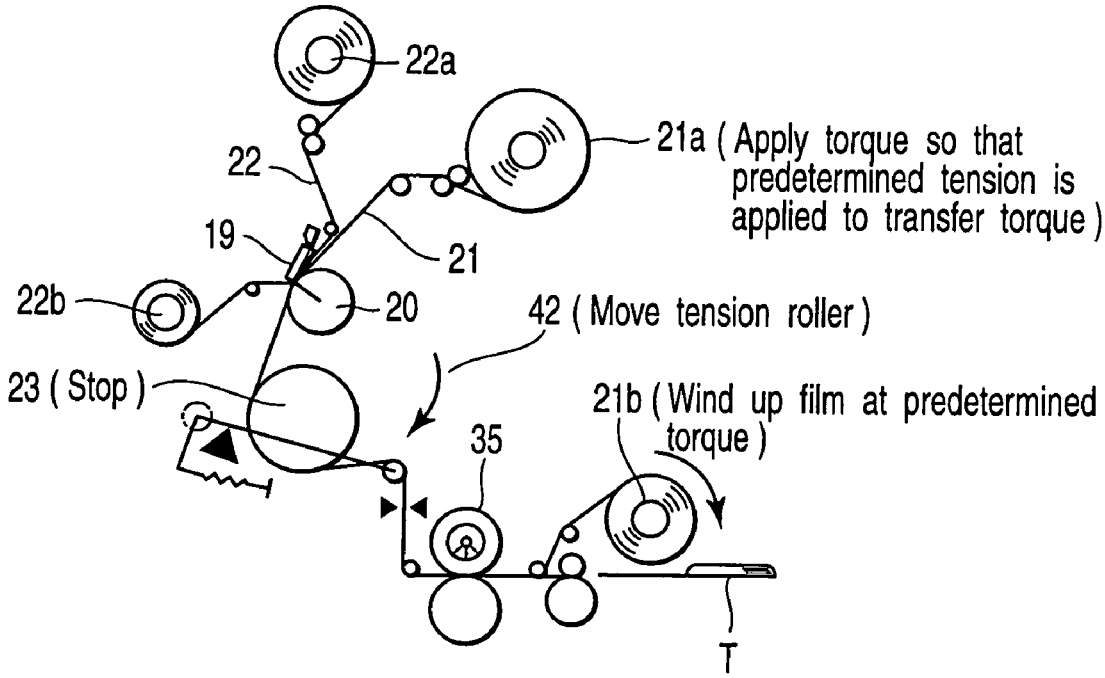
FIG. 3 is a view to explain the print and transfer operations of the transfer print section.

As shown in FIG. 3, the film drive roller 23 for feeding the intermediate transfer film 21 at the first speed is stopped. In this state, the wind-up reel 21*b* is rotated at predetermined torque, and the intermediate transfer film 21 is wound up while predetermined tension is applied to there. By doing so, the tension roller 42 is moved to a constant position balancing with the wind-up tension. The foregoing movement is detected by which a rotation detector (not shown) provided in the wind-up reel axis of the film 21 detects non-rotation state for predetermined period.

Figure 4:
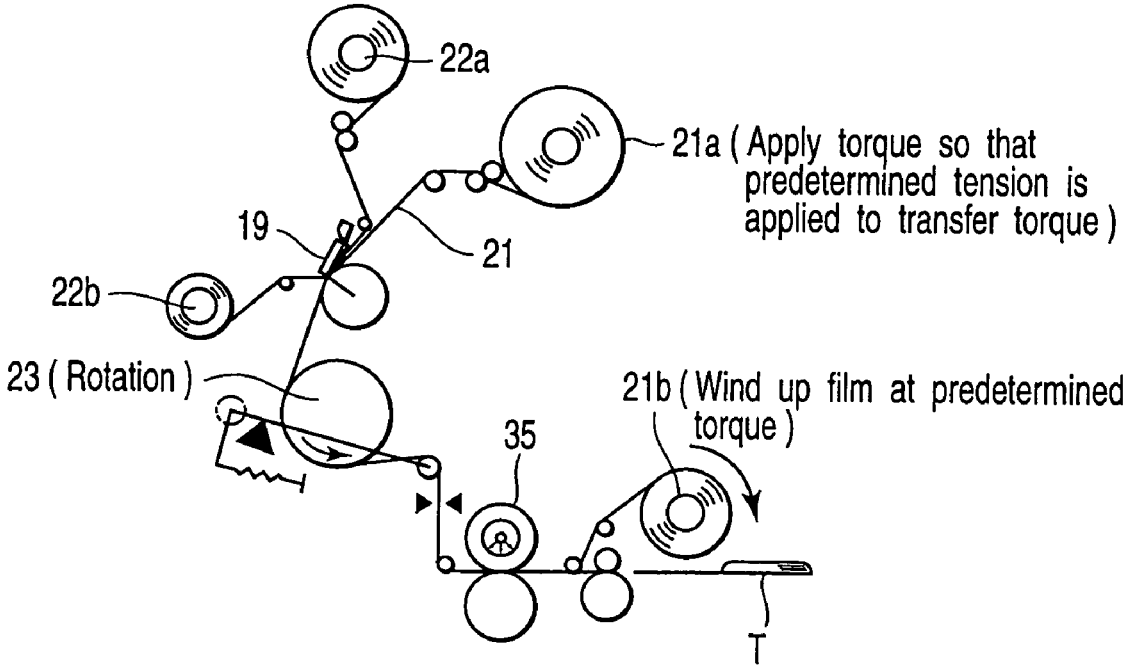
FIG. 4 is a view to explain the print and transfer operations of the transfer print section.

As illustrated in FIG. 4, the film drive roller 23 is rotated in a state of keeping the tension of the intermediate transfer film 21. The detector 39 detects the mark on the film 21, and thereafter, the film 21 is fed by a predetermined distance, and thereby, positioned to the transfer position.

When the tension roller 42 moves to the position balancing with the wind-up tension, the rotatable arm 41 is abutted against the stopper 44 controlling the movable range of the tension roller 42.

As described above, the wind-up reel 21*b* is rotated with predetermined toque in a state of stopping the film drive roller 23. By doing so, predetermined tension is applied to the intermediate transfer film 21 to move and fix the tension roller 42 to the predetermined position. Therefore, the tension roller 42 is fixed without using specific fixing mechanism like the conventional case; as a result, the structure is simplified.

According to the foregoing embodiment, the operation from print to transfer is made every screen. As seen from FIG. 5 to FIG. 8, the operation from print to transfer may be concurrently made, and thereby, processing efficiency of the printing apparatus is improved.

According to the operation from print to transfer made every screen, the intermediate transfer film 21 is positioned to the transfer position, and thereafter, transfer to the passbook T is soon started. If print and transfer operations are concurrently made, positioning operations for print and transfer must be made independently.

Figure 5:
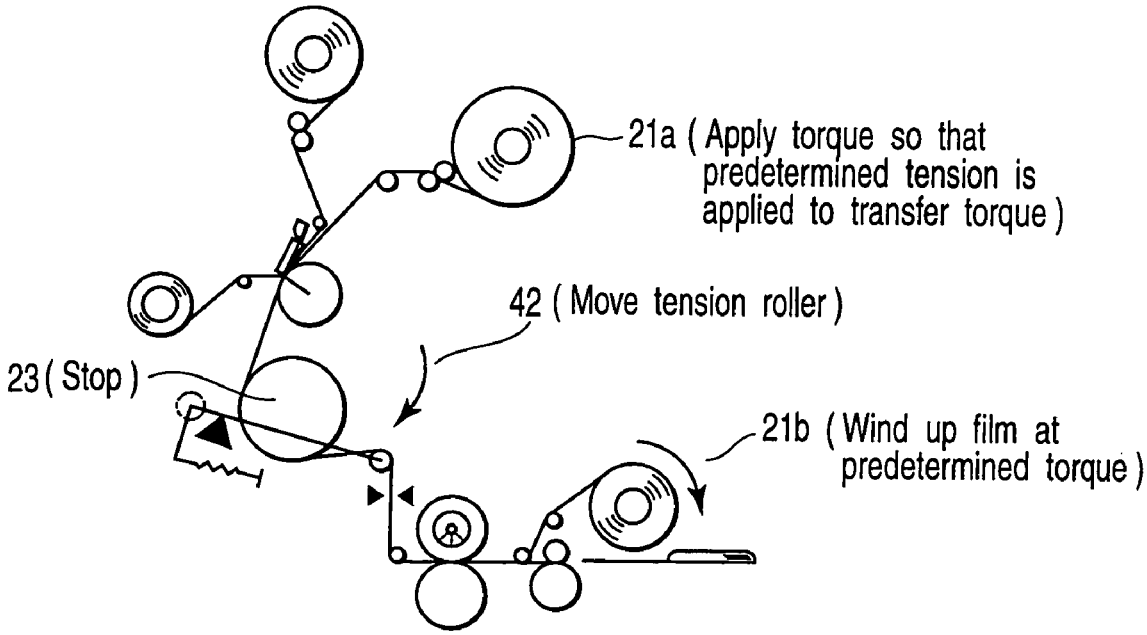
FIG. 5 is a view to explain the print and transfer operations according to a second embodiment of the present invention.
Figure 6:
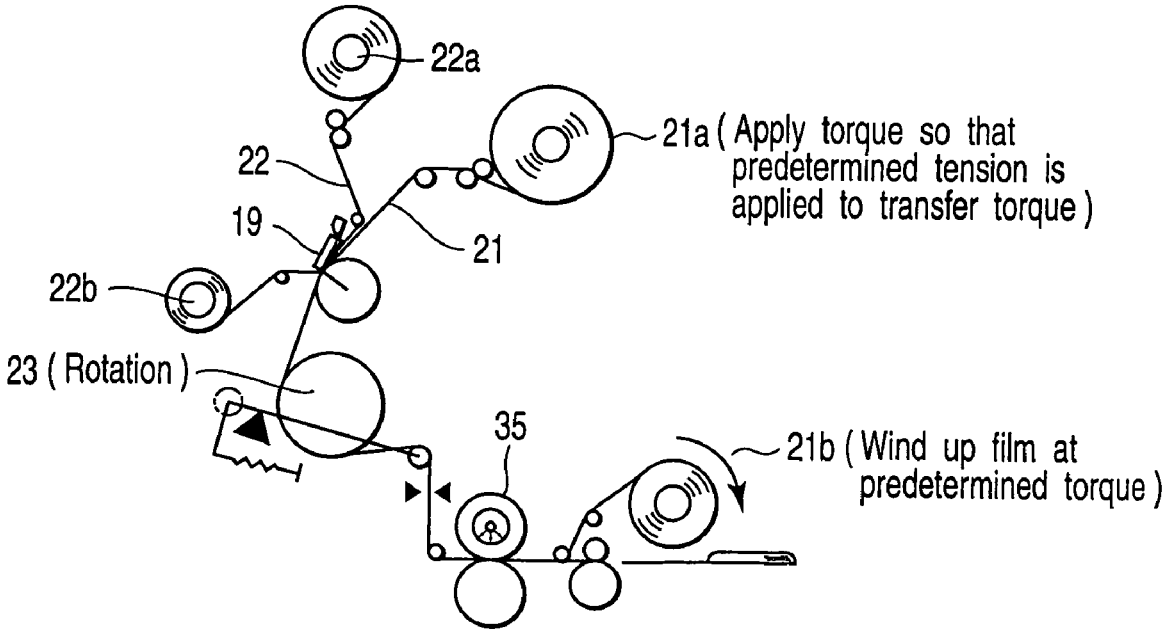
FIG. 6 is a view to explain the print and transfer operations of the second embodiment.

In order to concurrently make the print and transfer operations, the intermediate transfer film 21 is positioned to the transfer position like the case where the print and transfer operations are made every screen as depicted in FIG. 5 and FIG. 6.

Figure 7:
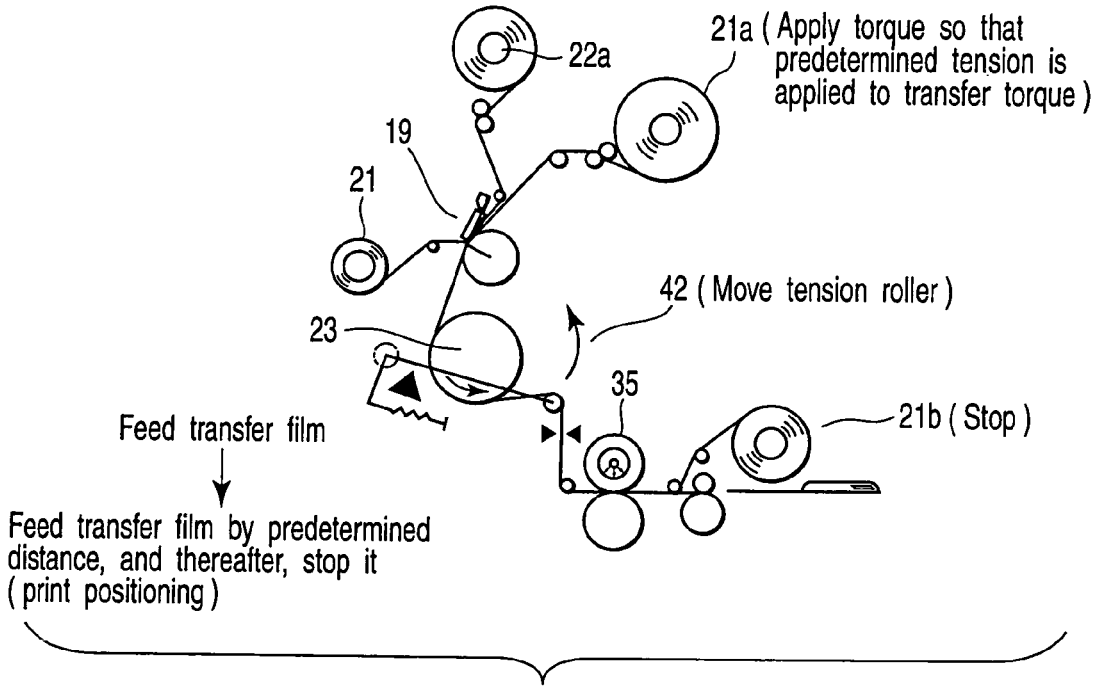
FIG. 7 is a view to explain the print and transfer operations of the second embodiment.

As shown in FIG. 7, the film wind-up axis of the wind-up reel 21*b* is fixed so that the intermediate transfer film 21 is not wound up. The film 21 is fed by predetermined distance via the rotation of the film drive roller 23, and thereby, positioned to the print position.

In this case, the fed film 21 is slackened off; however, movement of the tension roller 42 corrects the slack. Therefore, no slack occurs in the intermediate transfer film 21 over the entire transfer film feed path. Moreover, the film wind-up axis of the wind-up reel 21*b* is fixed; therefore, the intermediate transfer film 21 is not shifted from the transfer position because it is previously positioned to there. By doing so, transfer and print positions are individually positioned; therefore, the print and transfer operations are concurrently made as shown in FIG. 8.

Even if feed speed and distance in each of the print and transfer operations are different, the movement of the tension roller 42 corrects the slack of the intermediate transfer film 21.

When the print and transfer operations are concurrently made, a transfer film feed path length from print position to transfer position and a print image pitch on the transfer film must satisfy the following condition after positioning of the film 21 to the transfer position ends.

More specifically, it is necessary to satisfy the requirements of feeding the film 21 to achieve positioning to the print position, and to correct the feed of the film 21 by the movement of the tension roller 42. Moreover, if feed speed and feed distance are different between print and transfer, it is necessary to correct the difference between the feed distances by the movement of the tension roller 42.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A printing apparatus for passbooks comprising:

a first feed device feeding an intermediate transfer material at a first speed;

a print device printing information on the intermediate transfer material fed by the first feed device at a print position;

a second feed device feeding the intermediate transfer material printed with information by the print device to a transfer position at a second speed different from the first speed;

a transfer device transferring print information of the intermediate transfer material fed to the transfer position by the second feed device to passbooks;

a slack correction device stretching the intermediate transfer material across a tension roller, and correcting slack of the intermediate transfer material resulting from a difference in the feed speed between the first and second feed devices by movement of the tension roller; and a control device operating the second feed device to apply a predetermined tension to the intermediate transfer material, with the first feed device in a stopped state, thereby moving and fixing the tension roller to a predetermined position, and thereafter, feeding the intermediate transfer material by a predetermined distance by again operating the first feed device to position it to the transfer position.

2. The apparatus according to claim 1, wherein the slack correction device includes a rotatable arm rotating around a fulcrum roller, the tension roller attached to one end of the rotatable arm, and an urging member urging the other end thereof, and moves the tension roller by a urging force of the urging member to apply tension to the intermediate transfer material.

3. The apparatus according to claim 2, wherein the tension roller is moved to a predetermined position against the urging force of the urging member.

4. The apparatus according to claim 3, further comprising:

a stopper controlling a movement of the tension roller moving against the urging force of the urging member.

5. The apparatus according to claim 4, wherein the stopper is abutted against the rotatable arm to control the movement of the tension roller.

6. A printing apparatus for passbooks comprising:

a first feed device feeding an intermediate transfer material at a first speed;

a print device printing information on the intermediate transfer material fed by the first feed device at a print position;

a second feed device feeding the intermediate transfer material printed with information by the print device to a transfer position at a second speed different from the first speed;

a transfer device transferring print information of the intermediate transfer material fed to the transfer position by the second feed device to passbooks;

a slack correction device stretching the intermediate transfer material across a tension roller, and correcting slack of the intermediate transfer material resulting from a difference in the feed speed between the first and second feed devices by movement of the tension roller; and a control device operating the second feed device to apply a predetermined tension to the intermediate transfer material, with the first feed device in a stopped state, thereby moving and fixing the tension roller to a predetermined position, and thereafter, feeding the intermediate transfer material by a predetermined distance by again operating the first feed device to position it to the transfer position, and feeding the intermediate transfer material by a predetermined distance by the first feed device, with the second feed device in a stopped state, and thereby, positioning it to the print position.

7. The apparatus according to claim 6, wherein the slack correction device includes a rotatable arm rotating around a fulcrum roller, the tension roller attached to one end of the rotatable arm, and an urging member urging the other end thereof, and moves the tension roller by a urging force of the urging member to apply tension to the intermediate transfer material.

8. The apparatus according to claim 7, wherein the tension roller is moved to a predetermined position against the urging force of the urging member.

9. The apparatus according to claim 8, further comprising:

a stopper controlling a movement of the tension roller moving against the urging force of the urging member.

10. The apparatus according to claim 9, wherein the stopper is abutted against the rotatable arm to control the movement of the tension roller.

11. A printing method of passbooks comprising:

feeding an intermediate transfer material by a first feed device feeding at a first speed;

printing information on the intermediate transfer material fed by the first feed device at a print position;

feeding the intermediate transfer material printed with information by the print device to a transfer position by a second feed device at second speed different from the first speed;

transferring print information of the intermediate transfer material fed to the transfer position by the second feed device to passbooks;

stretching the intermediate transfer material across a tension roller, and correcting slack of the intermediate transfer material resulting from a difference in the feed speed between the first and second feed devices by movement of the tension roller; and operating the second feed device to apply a predetermined tension to the intermediate transfer material, with the first feed device in a stopped state, thereby moving and fixing the tension roller to a predetermined position, and thereafter, feeding the intermediate transfer material by a predetermined distance by again operating the first feed device to position it to the transfer position.

12. A printing method of passbooks comprising:

feeding an intermediate transfer material by a first feed device feeding at a first speed;

printing information on the intermediate transfer material fed by the first feed device at a print position;

feeding the intermediate transfer material printed with information by the print device to a transfer position by a second feed device at second speed different from the first speed;

transferring print information of the intermediate transfer material fed to the transfer position by the second feed device to passbooks;

stretching the intermediate transfer material across a tension roller, and correcting slack of the intermediate transfer material resulting from a difference in the feed speed between the first and second feed devices by movement of the tension roller; and operating the second feed device to apply a predetermined tension to the intermediate transfer material, with the first feed device in a stopped state, thereby moving and fixing the tension roller to a predetermined position, and thereafter, feeding the intermediate transfer material by a predetermined distance by again operating the first feed device to position it to the transfer position, and feeding the intermediate transfer material by a predetermined distance by the first feed device, with the second feed device in a stopped state, and thereby, positioning it to the print position.

* * * * *